United States Patent [19]

Olsson et al.

[11] Patent Number: 4,996,635

[45] Date of Patent: Feb. 26, 1991

[54] DEEP SUBMERSIBLE LIGHT ASSEMBLY WITH DRY PRESSURE DOME

[75] Inventors: Mark S. Olsson, San Diego; Samuel B. Parker, Venice; Douglas G. Rimer, San Diego, all of Calif.

[73] Assignee: Deepsea Power & Light, Inc., San Diego, Calif.

[21] Appl. No.: 420,909

[22] Filed: Oct. 13, 1989

[51] Int. Cl.[5] ..... F21V 29/00

[52] U.S. Cl. ..... 362/267; 362/158; 362/346; 362/373

[58] Field of Search ..... 362/263, 264, 294, 346, 362/362, 374, 375, 267, 158, 310, 373, 457, 458, 101

[56] References Cited

U.S. PATENT DOCUMENTS

| | | | |
|---|---|---|---|
| 3,652,846 | 3/1972 | Starck, II | 362/263 |
| 3,840,734 | 10/1974 | Oram | 362/267 |
| 4,259,710 | 3/1981 | Schlack | 362/267 |
| 4,450,511 | 5/1984 | Micha | 362/267 |
| 4,458,299 | 7/1984 | Stephens et al. | 362/267 |
| 4,683,523 | 7/1987 | Olsson et al. | 362/307 |

FOREIGN PATENT DOCUMENTS

| | | | |
|---|---|---|---|
| 2089015 | 6/1982 | United Kingdom | 362/158 |

OTHER PUBLICATIONS

Deep Sea Thallium Iodide Lights, Two Page Specification Sheet, Jul. 1988.

Deep Sea Sealites, Two page Specification Sheet, Jul. 1988.

Deep Sea Reflector Blueprint, ACAD/NOSC/REFL-SPOT; Dec. 27, 1986.

Deep Sea Light Assembly Blueprint NOSC-O, Jan. 10, 1988.

*Primary Examiner*—Stephen F. Husar

*Assistant Examiner*—D. M. Cox

*Attorney, Agent, or Firm*—Baker, Maxham, Jester & Meador

[57] ABSTRACT

A generally funnel-shaped main light body has a socket assembly mounted therein for supporting a lamp inside a rear neck portion thereof. A dome-shaped lens extends across a front flared portion of the main light body. A water-tight seal is provided between a periphery of the lens and the flared portion of the main light body. A reflector is mounted inside the flared portion of the main light body.

9 Claims, 2 Drawing Sheets

DEEP SUBMERSIBLE LIGHT ASSEMBLY WITH DRY PRESSURE DOME

BACKGROUND OF THE INVENTION

The present invention relates to light assemblies, and more particularly, to hydrodynamic light assemblies which are adapted to be mounted on deep submersible vehicles.

Both manned and remotely piloted deep submersible vehicles are typically equipped with external light assemblies for illuminating adjacent regions of the water and/or features otherwise hidden in virtual darkness. Such light assemblies must of course be capable of withstanding extremely high water pressures, e.g. 16,500 PSI hydrostatic pressure. They must also be capable of accommodating high internal lamp temperatures, and low external water temperatures, e.g. slightly below zero degrees C. They must also be capable of providing a high degree of illumination since practically no light from the surface penetrates to depths below several thousands of feet. Furthermore, visibility is frequently impaired by suspended particulate matter and other debris which can only be ameliorated with intense, controlled illumination. Such light assemblies must not have undue power consumption because these vehicles typically operate on battery power. They must have a reasonable degree of shock resistance in case the vehicle should collide with some obstruction during a mission.

One deep submersible light assembly that satisfies the foregoing criteria is disclosed in U.S. Pat. No. 4,683,523 granted July 28, 1987 to Mark G. Olsson et al. In that assembly, a quartz-halogen lamp is mounted to the forward end of a cylindrical metal sleeve screwed over the end of a hollow metal body. The lamp is surrounded by a relatively small protective glass envelope which is held within a cavity in the forward end of the sleeve by a special high pressure radial seal. A removable reflector fits over the forward ends of the sleeve and body, surrounding and enclosing the lamp and its protective envelope. A perforated transparent dome-shaped cover fits over the forward end of the reflector. Water flows into the reflector cavity and directly contacts the protective envelope, otherwise the reflector would collapse from the tremendous water pressures encountered. The reflector is made of an inner body defining a parabolic or other reflecting surface and an outer protective body. These reflector bodies are made of cast polyurethane, DELRIN (Trademark), Aluminum or other suitable material capable of absorbing blows. They can be shaped for different mission requirements, e.g. spot or flood.

While the foregoing patented lamp assembly has been quite successful, it has been found that particles of matter suspended in the water inside the reflector and behind the dome-shaped cover can significantly affect the efficiency of the reflector. If one were to design a deep submersible light assembly in which the water does not enter the reflector, i.e. a "dry" reflector type light assembly, it would require some sort of transparent cover and seal assembly that could withstand tremendous water pressures without rupturing or leaking.

SUMMARY OF THE INVENTION

It is therefore the primary object of the present invention to provide a deep submersible hydrodynamic light assembly having a "dry" reflector interior, i.e. pressure dome.

According to the illustrated embodiment of the present invention, a generally funnel-shaped main light body has a socket assembly mounted therein for supporting a lamp inside a rear neck portion thereof. A dome-shaped lens extends across a front flared portion of the main light body. A water-tight seal is provided between a periphery of the lens and the flared portion of the main light body. A reflector is mounted inside the flared portion of the main light body.

DESCRIPTION OF THE PREFERRED EMBODIMENTS

Figures 1, 2:
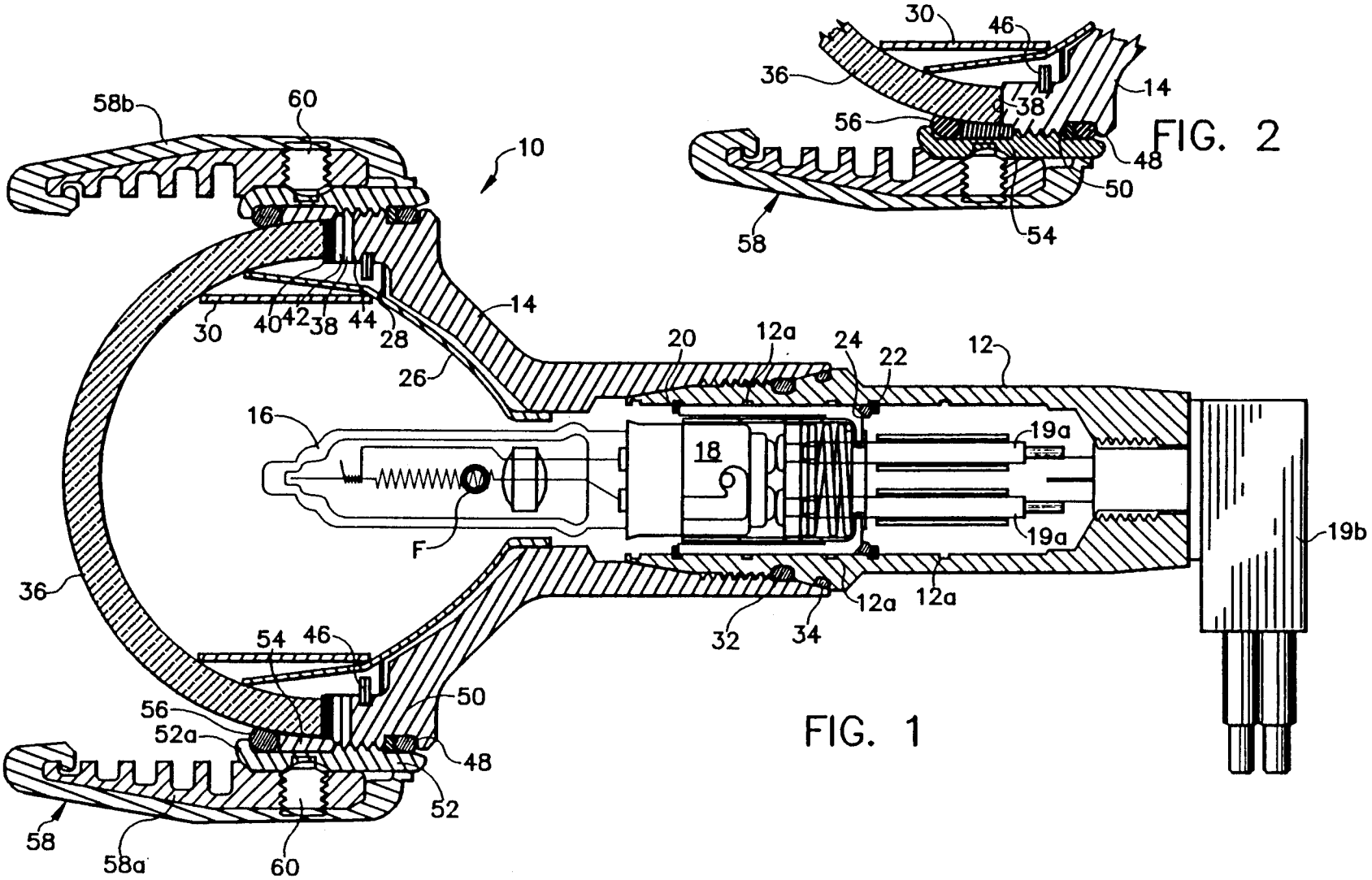
FIG. 1 is a longitudinal sectional view of a first embodiment of the light assembly of the present invention.
FIG. 2 is a fragmentary longitudinal sectional view of a second embodiment of the light assembly of the present invention.

Referring to FIG. 1, in accordance with a first embodiment of the present invention, a deeply submersible light assembly 10 includes a cylindrical socket body 12 having an externally threaded forward portion over which the internally threaded neck portion of a generally funnel-shaped main light body 14 is screwed. The socket body 12 and main light body 14 may be machined from 6061 T-6 Aluminum which is then provided with a hard black anodize exterior finish.

The socket body 12 has a plurality of annular grooves **12*a* formed in the inside wall thereof. These grooves are parallel and spaced along the longitudinal axis of the socket body. A quartz-halogen lamp 16 is removably connected to a socket assembly 18 rigidly mounted inside the forward portion of the socket body 12 via spiral retaining rings 20 and 22 seated in the interior grooves 12*a*. Wires 19*a* extend rearwardly from the socket assembly 18 through a bulkhead connector assembly 19*b* for connection to a suitable power source, typically 12 to 240 volts AC or DC. An O-ring 24 is positioned between the rear of the socket assembly 18 and the retaining ring 22. The retaining rings 20 and 22 can be repositioned in different ones of the grooves 12*a*** to accommodate lamps of varying longitudinal dimensions.

A spun Aluminum parabolic diffuse specular reflector 26 has a neck portion which extends into the neck portion of the main light body 14 and a flared portion which extends into the dome, beyond the flared portion of the main light body. A small wave spring 28 is seated on an inner shoulder of the main light body and engages the flared portion of the reflector 26 to hold it in position.

An optional cylindrical Aluminum light baffle 30 fits within and extends slightly beyond the periphery of the parabolic reflector 26. It is a short tubular section of black anodized Aluminum. Its purpose is to clip the light beam, i.e. reduce spill light from the sides of the beam. It could have a slightly stepped or roughened inside surface (not shown) to maximize light absorption. The baffle 30 is trapped between the reflector and the lens. The wave spring 28 tensions the reflector toward the lens. The socket assembly 18 is mounted at a preselected longitudinal position inside the socket body 12 in order to position the greatest point of illumination of the lamp 16 at the focus of the parabolic reflector 26. The focus is indicated by the dark circle F at the rear end of the filament of the lamp 16.

O-rings 32 and 34 are seated in grooves in the exterior of the rear portion of the socket body 12 to prevent water from leaking in between the socket body and the neck portion of the main light body 14.

A molded dome-shaped lens 36 is positioned within the flared portion of the main light body 14. It is preferably made of tempered borosilicate glass which may be clear or frosted.

Glass has a low coefficient of thermal expansion as well as a low modulus of elasticity compared to metals. For this reason, glass against metal areas at high pressure tend to fracture because of differential movement between the glass and the metal. Above 6000PSI the aluminum starts to collapse under the loading of the glass and will cause the glass dome to fail. For higher pressure applications, a sandwich of thin titanium wafers may be used to create slip planes to allow for differential sliding between the glass dome and the metal housing. These wafers can be made of other metals as well and can be surface treated with anodizing or TEFLON to increase the sliding action and prevent frictional lockup.

Any lubricants on the glass to metal seating area tend to cause the glass to fracture. Using seating wafers however, allows the use of lubricants or thin compliant layers between wafers. Molybdenum disulfide power or grease can act as a high pressure lubricant between wafers. Kapton or Mylar films can be sandwiched between wafers to increase compliance.

The means for sealing the dome-shaped lens to the light body preferably uses Tetrafluoroethylene sold under the trademark TEFLON to make a water tight seal at very high pressures. It is much more extrusion resistant than a rubber O-ring. A rubber O-ring will tend to extrude underneath the glass at high pressures (with repetitive cycles). This can cause uneven loading on the glass seat and cause the dome to break/fail/-crack. TEFLON material however is not a reliable low pressure seal and so the primary low pressure seals are rubber (elastomeric) O-rings.

In the embodiment of FIG. 1, the flared portion of the main light body 14 has a shoulder 38 which provides a seat for a series of shims or rings (hereinafter described) that abut the rear lip of the dome-shaped lens. Because of the tremendous water pressures exerted on the exterior of the lens it is critical that the surface of the shoulder 38 be as planar and smooth as possible. Also, the rear lip of the lens 36 must similarly be smooth and flat to evenly distribute the forces from the glass to the shims. Small spallation chips can occur at the base of the dome-shaped lens 36. If these chips are very large they can cross the boundary of the seal hereafter described, resulting in leakage.

A pair of 6AL-4V Titanium rings 40 sit against the rear lip of the lens 36. A 7075-T6 Aluminum ring 42 sits behind the rings 40. Another 6AL-4V Titanium ring 44 sits between the ring 42 and the shoulder 38. A snap ring 46 sits in an annular recess in the interior of the main light body 14 and holds in the wave spring 28. A VITON or silicone O-ring 48 seats in an external groove in the end of the main light body 14. A TEFLON backup ring 50 sits in the same groove ahead of the O-ring 48. The O-ring 48 and TEFLON backup ring 50 together provide a water tight seal.

An internally threaded metal sleeve 52 screws over the threads on the exterior of the forward end of the light body 14. The sleeve has an inwardly turned forward lip **52*a*. A TEFLON seal ring 54 and a silicon O-ring 56 are squeezed between the lens 36 and the sleeve 52** to provide another water tight seal.

The first embodiment of our light assembly further includes a light control shroud 58 which surrounds the sleeve 52 and extends therebeyond. This is important because the dome-shaped lens tends to refract the light sharply to the sides and produce stray or spill light. A metal portion **58*a* of the shroud is held to the sleeve 52 by set screws 60. The set screws 60 may be made of NYLON (Trademark). A neoprene shroud portion 58*b*** provides bumper protection to prevent damage to the dome-shaped lens. It also helps to direct the light forward and prevent sideways direction of the light. The shroud may be provided with vents (not shown) to permit the escape of trapped gases between the lens and the shroud. This will prevent the build up of a hot gas bubble against the outside of the dome-shaped lens.

An important feature of our invention is that the reflector 26 and optional baffle 30 extend into the interior of the dome-shaped lens 36. This is important because light that hits the edges of the lens is more highly refracted to the sides. This "spill" light is a much greater problem underwater than in air due to the blinding back scatter.

The underwater light assembly illustrated in FIG. 1 is particularly well suited for underwater applications requiring wide illumination areas, such as motion picture filming. By way of example, it may be designed for lamp wattages from 50 to 2000. Re-lamping may be completed without tools, and removal of the light assembly from its vehicle mount is not required in most instances. The re-lamping procedure preserves the front lens seal. The internal reflector design affords easy removal of marine growth form the outer lens assuring consistent light output. Since water does not enter the reflector, debris carried thereby does not interfere with the operation of the reflector and/or the baffle. Different internal reflectors can readily be interchanged to achieve spot, flood and other beam patterns. The use of an internal reflector that extends into the dome-shaped lens allows for efficient loss of heat into the surrounding air or water rather than into the light body 14.

FIG. 2 illustrates a second embodiment of our invention adapted for use at lower water depths where lower water pressures permit the rear lip of the dome-shaped lens 36 to directly abutt the shoulder 38 of the main light body 14. The construction of the second embodiment is otherwise the same as the construction of the first embodiment, as indicated by the like reference numerals.

Figure 3:
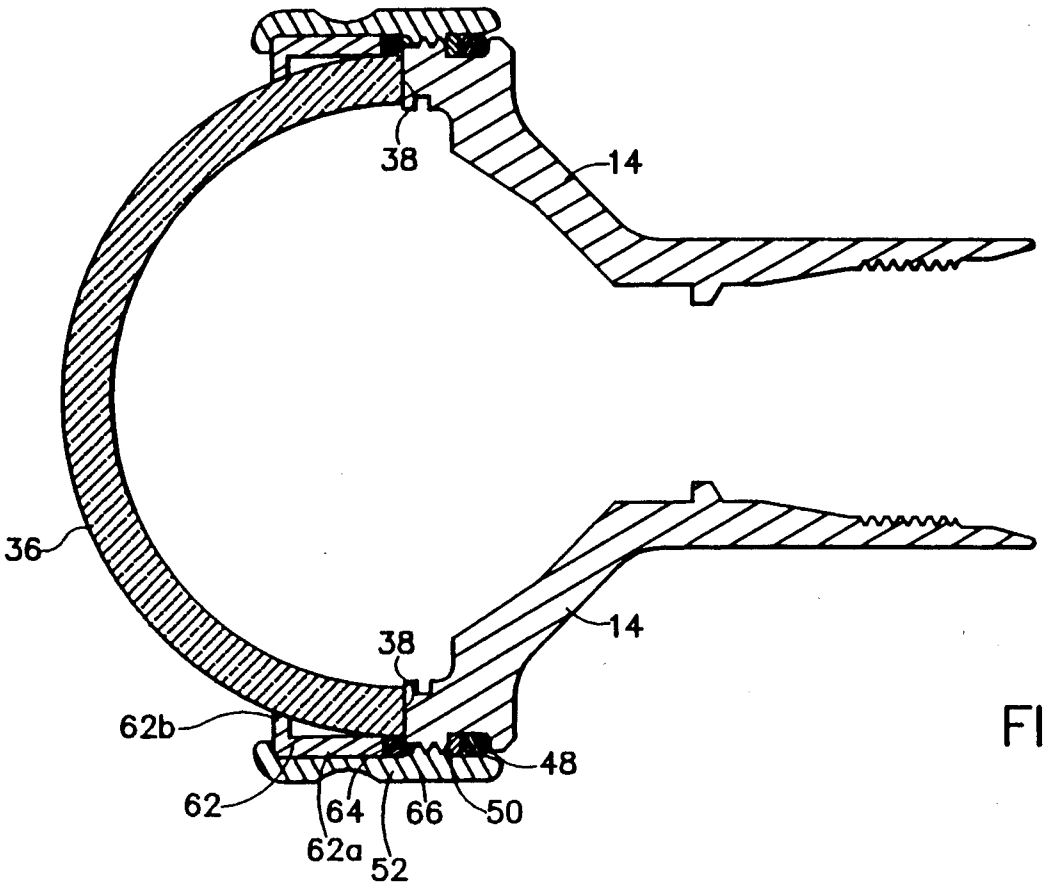
FIG. 3 is a longitudinal sectional view of the lens, light body and seal of a third embodiment of the light assembly of the present invention.

Referring to FIG. 3, a third embodiment of our invention includes a split TEFLON seal as an over-pressure mechanism in environments where water pressure is low or the light is used in ambiant air. Such a venting mechanism is necessary for the safe use of high wattage lamps when they are operating in ambient air. Venting prevents the explosion of the light housing due to increasing internal pressure. The internal pressure will reach catastrophic levels if any water or moisture is inside the light housing during operation. Referring to FIG. 3, the rear lip of the dome-shaped lens 36 abutts directly against the shoulder 38 of the funnel-shaped light body 14, the same as in the second embodiment discussed above. As in the first and second embodiments, the internally threaded metal sleeve 52 screws over the threads on the exterior of the forward end of the light body 14. The combination of the VITON or silicone O-ring 48 and TEFLON backup ring 50 provide a water tight seal between the metal sleeve 52 and the light body 14 at the rear end of the sleeve. A split TEFLON seal 62 is positioned between the forward part of the metal sleeve 52, the rear outer periphery of the dome-shaped lens 36 and the inwardly turned forward lip of the sleeve 52. A pair of silicone O-rings 64 and 66 are also positioned between the metal sleeve 52, light body 14 and the rear of the dome-shaped lens 36, behind the split TEFLON seal 62. The TEFLON seal 62 is split radially in one place to allow venting and has a step therein, i.e. it has a cylindrical portion **62*a* coaxial with the longitudinal axis of the light, and a radially inwardly turned portion 62*b*. As the lamp inside the light heats up pressure begins to build in the interior of the light housing. This interior is the region between the lens 36 and the light body 14 which encloses the lamp 16. If any water is present inside the housing the flashing of liquid into gas will cause significant pressure-buildup. The dome-shaped lens 36 will unseat, i.e. its rear lip will pull away from the shoulder 38 at a predetermined level of internal pressure, e.g. 35 PSI. Excessive internal pressure is vented through the TEFLON seal 62. The dome-shaped lens is prevented from shooting off, i.e. completely exploding away from a light body, by the step in the TEFLON seal 62. In other words, the step 62*b* retracts radially outwardly slightly from the curved exterior of the dome-shaped lens 36 to permit the escape of gas. After the excessive pressure is vented, the dome-shape lens will again seat itself against the shoulder 38 of a light body 14. The step 62*b* in the TEFLON seal acts as a spring to force the dome-shape lens 36 to seat against the light body 14. So in summary, the L-shaped cross section of the seal 62*a*** prevents the dome from detaching from the light body, permits high pressure gas within the light assembly to escape, and acts as a spring to cause the dome-shaped lens to reseat.

While I have described several preferred embodiment of our deep submersible light assembly with a dry pressure dome, it should be understood that modifications and adaptations thereof will occur to persons skilled in the art. For example, our design could accommodate a flat window one-half inch thick in place of the dome-shaped lens. The dome is an ideal shape for pressure bearing, but can cause optical problems with beam control if not properly used. While a flat lens would not accommodate high pressures as well as a dome-shaped lens, it allows narrower spot beams. A partial dome, intermediate a flat window and a full dome could also be utilized. The same multi-ring seat for a dome-shaped lens could be employed in other applications, e.g. an underwater TV camera. Therefore, the protection afforded our invention should only be limited in accordance with the scope of the following claims.

We claim:

1. A deep submersible light assembly comprising:

a generally funnel-shaped main light body;

means for supporting a lamp inside a rear neck portion of the main light body including a socket assembly;

a dome-shaped lens sized to extend across a front flared portion of the main light body;

means including a plurality of rings for providing a water-tight seal between a peripheral rear lip of the lens and a shoulder of the flared portion of the main light body;

a reflector mounted inside the flared portion of the main light body; and a spring seated on an inner shoulder of the flared portion of the main light body and engaging the reflector to hold it in position.

2. A deep submersible light assembly according to claim 1 wherein the means for providing a water-tight seal further includes a sleeve surrounding the front flared portion of the light body and the rear lip of the lens and squeezing therebetween a seal ring.

3. A deep submersible light assembly according to claim 1 and further comprising a cylindrical shroud surrounding the flared portion of the main light body and extending forwardly therebeyond.

4. A deep submersible light assembly according to claim 1 wherein an interior surface of the baffle facing the lamp is blackened.

5. A deep submersible light assembly according to claim 1 wherein at least some of the rings are made of Titanium.

6. A deep submersible light assembly according to claim 1 wherein the lamp supporting means further includes a hollow cylindrical socket body for receiving the socket assembly, the rear neck portion of the main light body screws over the socket body, and second water-tight seal means is provided between the rear neck portion of the main light body and the socket body.

7. A deep submersible light assembly, comprising:

a generally funnel-shaped main light body;

means for supporting a lamp inside a rear neck portion of the main light body including a socket assembly;

a lens sized to extend across a front flared portion of the main light body;

means for providing a water-tight seal between a periphery of the lens and the flared portion of the main light body including a split L-shaped seal ring that allows the lens to unseal under internal pressure; and a reflector mounted inside the flared portion of the main light body.

8. A deep submersible light assembly, comprising:

a generally funnel-shaped main light body;

means for supporting a lamp inside a rear neck portion of the main light body including a socket assembly;

a dome-shaped lens sized to extend across a front flared portion of the main light body;

means including a plurality of rings for providing a water-tight seal between a peripheral rear lip of the lens and a shoulder of the flared portion of the main light body; and a reflector mounted inside the flared portion of the main light body, the reflector extending beyond the junction of a rear lip of the lens and the shoulder of the flared portion of the main light body.

9. A deep submersible light assembly, comprising:

a generally funnel-shaped main light body;

means for supporting a lamp inside a rear neck portion of the main light body including a socket assembly;

a dome-shaped lens sized to extend across a front flared portion of the main light body;

a split L-shaped seal ring positioned between a peripheral rear lip of the lens and a shoulder of the flared portion of the main light body for providing a water-tight seal and for allowing the lens to unseal under internal pressure; and a reflector mounted inside the flared portion of the main light body.

* * * * *